US006992585B2

(12) United States Patent
Saleh et al.

(10) Patent No.: US 6,992,585 B2
(45) Date of Patent: Jan. 31, 2006

(54) SECURITY SYSTEM INCORPORATING A SINGLE MODULAR UNIT MOTION SENSOR

(76) Inventors: Rameez Saleh, 204584 Yale university, New Haven, CT (US) 06520; James Frank Klemic, 260 Willow St., New Haven, CT (US) 06511; Abigail Lubow, 5711 Oakshire Rd., Baltimore, MD (US) 21209; Mark Meras, 135 Covent Gardens La., Amherst, NY (US) 14221

( * ) Notice: Subject to any disclaimer, the term of this patent is extended or adjusted under 35 U.S.C. 154(b) by 370 days.

(21) Appl. No.: 10/138,132

(22) Filed: May 2, 2002

(65) Prior Publication Data

US 2003/0062999 A1 Apr. 3, 2003

Related U.S. Application Data

(60) Provisional application No. 60/326,747, filed on Oct. 2, 2001.

(51) Int. Cl.
*G08B 13/14* (2006.01)

(52) U.S. Cl. ..... 340/571; 340/522; 340/568.1

(58) Field of Classification Search ..... 340/573.1, 340/573.4, 573.7, 571, 575, 576, 568.1, 686.6, 340/572.1, 506, 522, 539.1; 128/204.23
See application file for complete search history.

(56) References Cited

U.S. PATENT DOCUMENTS

| | | | | |
|---|---|---|---|---|
| 3,597,753 A | | 8/1971 | Tabankin | 340/539.31 |
| 3,721,956 A | | 3/1973 | Hamann et al. | 340/429 |
| 3,914,756 A | | 10/1975 | Seyk | 340/571 |
| 4,190,828 A | | 2/1980 | Wolf | 340/571 |
| 4,450,326 A | | 5/1984 | Ledger | 200/61.45 M |
| 4,780,704 A | | 10/1988 | Tommasini | 340/572.1 |
| 5,258,743 A | | 11/1993 | Nelson et al. | 340/568.1 |
| 5,317,304 A | | 5/1994 | Choi | 340/571 |
| 5,406,261 A | * | 4/1995 | Glenn | 340/571 |
| 5,541,578 A | | 7/1996 | Lussey | 340/571 |
| 5,574,429 A | | 11/1996 | Streeter | 340/571 |
| 5,576,693 A | | 11/1996 | Tyren et al. | 340/572.4 |
| 5,578,991 A | | 11/1996 | Scholder | 340/571 |
| 5,610,587 A | | 3/1997 | Fujiuchi et al. | 340/572.1 |
| 5,677,850 A | | 10/1997 | Ott | 702/42 |
| 5,757,270 A | | 5/1998 | Mori | 340/568.1 |
| 5,760,690 A | | 6/1998 | French | 340/571 |
| 5,767,771 A | | 6/1998 | Lamont | 340/571 |
| 5,788,271 A | | 8/1998 | Sotelo | 280/730.1 |
| 5,801,627 A | | 9/1998 | Hartung | 340/568.1 |
| 5,801,629 A | | 9/1998 | Lehmann et al. | 340/571 |
| 5,841,354 A | * | 11/1998 | Bae et al. | 340/575 |
| 5,926,092 A | | 7/1999 | Kim | 340/571 |
| 5,963,131 A | | 10/1999 | D'Angelo et al. | 340/568.1 |
| 6,011,471 A | | 1/2000 | Huang | 340/568.1 |
| 6,060,336 A | | 5/2000 | Wan | 438/50 |
| 6,087,937 A | | 7/2000 | McCarthy | 340/567 |

(Continued)

*Primary Examiner*—Van T. Trieu
(74) *Attorney, Agent, or Firm*—Gifford, Krass, Groh, Sprinkle, Anderson & Citkowski, P.C.

(57) ABSTRACT

A security system includes within a single module in combination an arming component, a motion sensing component and a notifier component. The arming component creating an output signal received by the motion sensor component, which in turn generates an alarm signal upon the motion sensor being moved. The alarm signal activates a notifier component to broadcast notification of unauthorized movement of the system. A MEMS motion sensor and a trigger optimally serve as the basis for the motion sensing component.

24 Claims, 8 Drawing Sheets

U.S. PATENT DOCUMENTS

| | | | | |
|---|---|---|---|---|
| 6,133,830 | A | 10/2000 | D'Angelo et al. | 340/571 |
| 6,137,409 | A | 10/2000 | Stephens | 340/568.1 |
| 6,166,635 | A | 12/2000 | Huang | 340/571 |
| 6,172,607 | B1 | 1/2001 | McDonald | 340/571 |
| 6,230,566 | B1 | 5/2001 | Lee et al. | 73/514.32 |
| 6,249,219 | B1 | 6/2001 | Perez et al. | 340/467 |
| 6,249,729 | B1 | 6/2001 | Corrado et al. | 701/45 |
| 6,249,730 | B1 | 6/2001 | Khairallah et al. | 701/45 |
| 6,271,801 | B2 | 8/2001 | Tuttle et al. | 343/872 |
| 6,448,895 | B1 * | 9/2002 | Ekkel | 340/573.1 |
| 6,532,958 | B1 * | 3/2003 | Buan et al. | 128/204.23 |
| 6,642,067 | B2 * | 11/2003 | Dwyer | 438/17 |
| 2001/0038330 | A1 | 11/2001 | Garcia | 340/568.1 |

* cited by examiner

POWER INTEGRATION
FIG. 6A
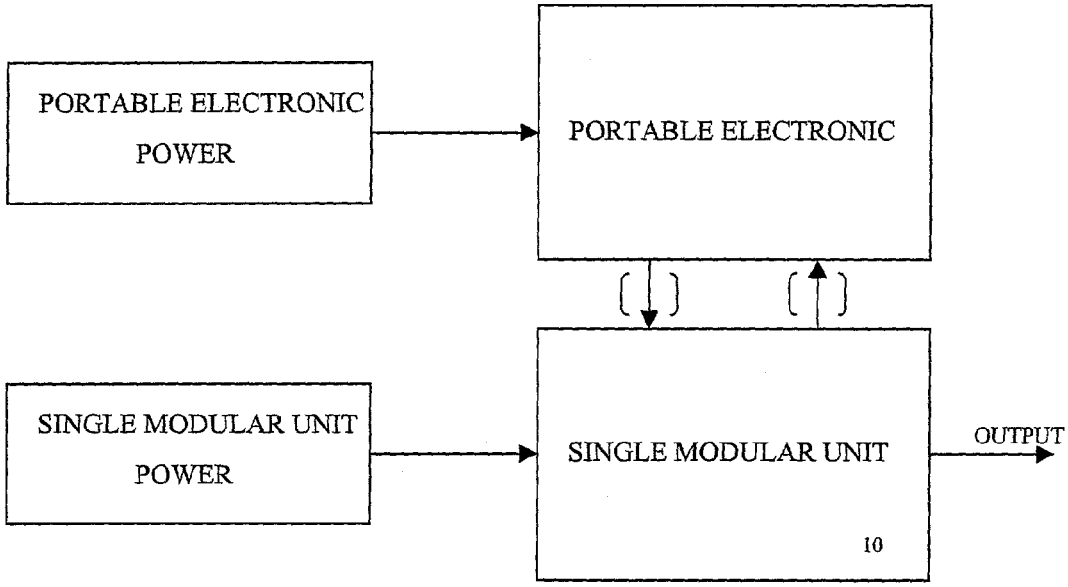
FIG 6B
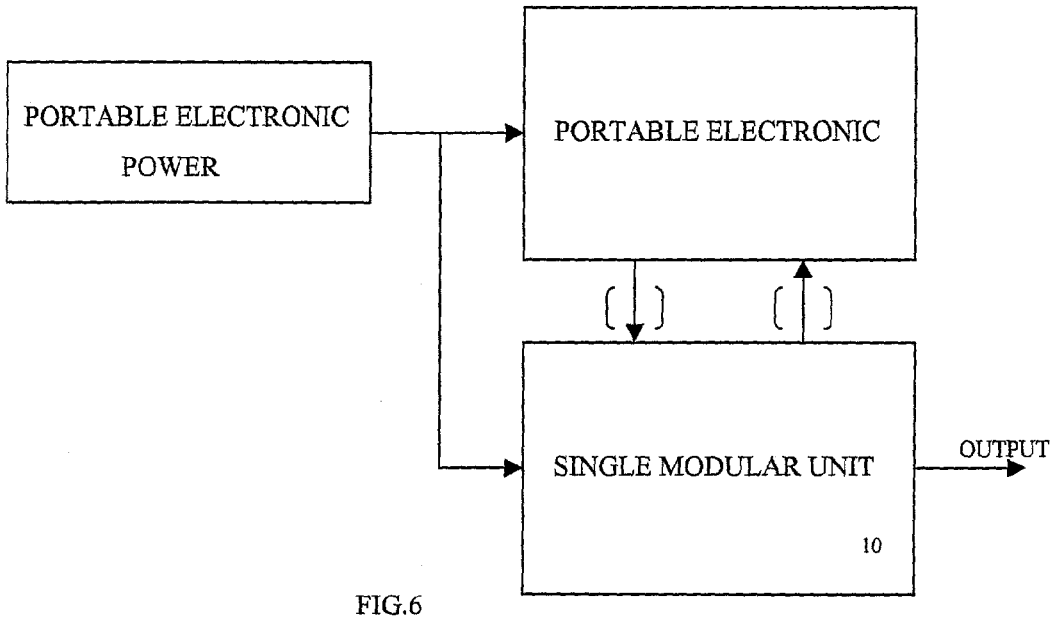
FIG.6

AUDIO / VISUAL INTEGRATION

SECURITY SYSTEM INCORPORATING A SINGLE MODULAR UNIT MOTION SENSOR

RELATED APPLICATION

This application claims priority of U.S. Provisional Patent Application Ser. No. 60/326,747 filed Oct. 2, 2001, which is herein incorporated by reference.

FIELD OF THE INVENTION

This invention relates generally to a security system for portable electronics and more particularly to a miniaturized module capable of triggering an alarm signal upon the movement of the module.

BACKGROUND OF THE INVENTION

As society becomes more mobile, concerns about personal effect security have increased. In particular, theft of portable electronic devices such as notebook computers, portable digital assistants (PDAs), video camcorders and digital cameras is a growing concern for the users and owners of these articles. Small valuable articles such as portable electronics devices have increased intrinsic value due to the information stored in them.

Due to their small size, portable electronics get stolen. For example, in 1999 approximately 416,000 notebooks were stolen in the U.S. alone—90% are not retrieved (Targus Group Intl '2001'). A simple anti-theft device in common use is a cable lock. Undoubtedly, the inconveniences associated with having to carry the cable lock, as well as restrictions on mobility of the portable electronic, require a more sophisticated, smaller and convenient anti-theft mechanism.

Existing anti-theft systems such as the Targus Defcon 1 manufactured by the Targus Group Intl, as well as inventions in Unexamined Japanese Patent Publication (KOKAI) No. 3-225597, U.S. Pat. No. 5,757,270 and U.S. Pat. No. 5,317,304 are devices which are large in comparison to the portable electronic. With respect to the Targus Defcon 1, the dimensions are approximately one-fifth of the size of a 12.1" screen notebook computer and the approximate dimensions of a PDA or digital camera. The necessity of having to carry an external device in addition to the portable electronic with current devices places limitations on user mobility. The utility of existing anti-theft systems is further limited to a comparatively large portable electronic device such as a laptop computer, and impractical to couple with a small device such as a PDA, camcorder or smaller personal articles such as jewelry or watches.

U.S. Pat. No. 6,133,830 is exemplary of these devices and has an anti-theft system that relies on the interaction of the owner/user with the portable electronic. The anti-theft system includes a control unit and a theft detector, with the theft detector attached to a portable electronic device. Upon the detection of motion, the user is notified via a signal to the control unit in the possession of a remote user. The user then determines whether to trigger the alarm. As with other existing systems, the size of the theft detector restricts the mobility of the user. Thus, there exists a need for a security system that is small enough to integrate into, or attach to any portable electronic device or personal article without hindering the mobility of the user thereof.

SUMMARY OF THE INVENTION

A security system includes in combination within a single chip module an arming component that creates an output signal. A motion sensing component is activated by the output signal from the arming component and in turn generates an alarm signal upon the system being moved. A notifier component is activated by the receipt of the alarm signal in order to broadcast notification of unauthorized system movement. In the preferred embodiment, the motion sensing component includes a MEMS motion sensor and a trigger therefor. The trigger is activated by the output signal from the arming component reaching the trigger and generating the alarm signal upon the MEMS motion sensor being moved. A process for indicating unauthorized movement of a portable electronic includes coupling a security system to a portable electronic and energizing the security system. The security system including within a single module in combination an arming component, a motion sensing component and a notifier component. The arming component creating an output signal that activates a motion sensing component to generate an alarm signal upon the system being moved. Receipt of the alarm signal by the notifier component broadcasts notification of unauthorized system movement.

BRIEF DESCRIPTION OF THE DRAWINGS

Features of the invention can be understood more readily by reference to the accompanying drawings in which:

FIG. 6 is a diagram of the embodiments for power integration of the SMU into the PE.

DETAILED DESCRIPTION OF THE PREFERRED EMBODIMENTS

Figure 1:
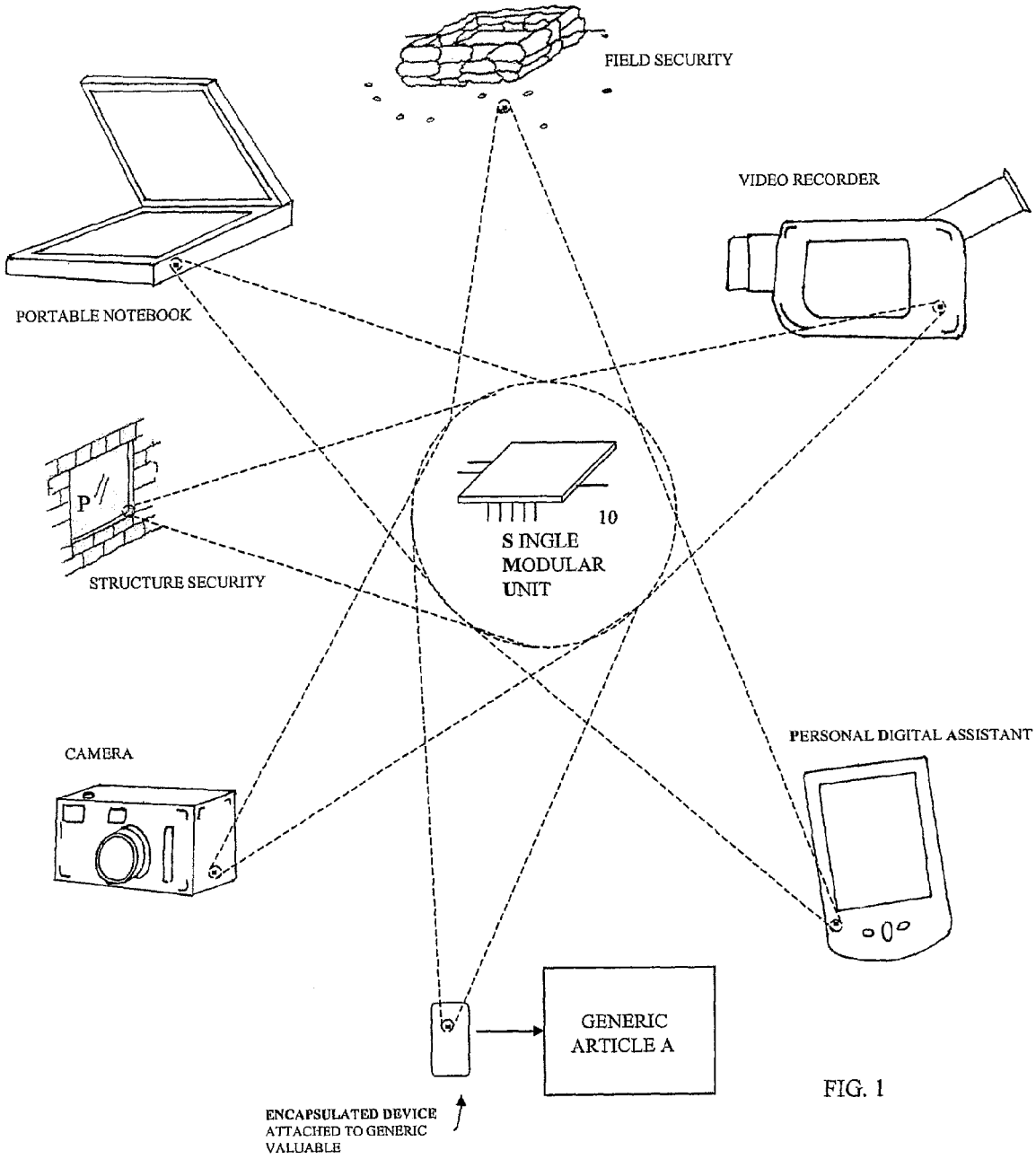
FIG. 1 is an illustration of an embodiment of the SMU integrated or attached into examples of general PEs. The examples of PEs are provided to facilitate the understanding of the invention and should not be interpreted to limit the scope of the invention.

The present invention is an anti-theft security system for portable electronics (PE), such as notebook computers, portable digital assistants (PDAs), video camcorders and digital cameras. The present invention is a universal single modular unit (SMU) with dimensions on the scale of an integrated circuit, and low power consumption. The present invention is readily integrated directly into most portable electronic goods, jewelry or into an encapsulated device that can be attached to the PE. The basis of the system is a motion sensor which in a specific embodiment can be made using Micro Electro Mechanical Systems (MEMS) fabrication technology and is packaged into the single modular electronic unit. The components of the system are a SMU, an arm/disarm mechanism, a sound system and a power supply. The security system integrated into or attached to the PE, when armed, can sense motion. If motion is sensed, an alarm is signaled through the alarm system. The alarm can only be disarmed through the arm/disarm mechanism. Furthermore, the PE can stop functioning until disarmed. The intention of the system is to discourage the opportunistic theft of the PE through both an alarm and the knowledge that the PE is armed with the device.

The present invention provides a security system for portable electronics, jewelry and other small personal items. These uses are made possible by the device size being on the scale of a singular or plural integrated circuit chips that are capable of being packaged in an encapsulated system. The small size and corresponding low power consumption affords a more versatile system relative to the prior art. In an alternate embodiment, an array of single module units is dispersed to form a security perimeter effective against trespassers and other intruders.

The present invention operates by sensing an unauthorized motion of the single module unit security system and the attached article. An audible alarm is emitted to deter further motion and draw attention to the inventive system so as to deter theft. It is appreciated that an inventive single module unit is comparatively inexpensive to produce and has performance characteristics making it suitable to integrate into or attach to most personal articles. Personal articles suitable for attachment of the present invention illustratively include portable electronics such as a laptop computer, PDA, video camera, camera, and cell phones; jewelry such as a ring, watch, pendant; personal articles such as a wallet, pen, key, key chain, coat, purse and identification document. The compact design of the inventive system renders it amenable to retrofitting to an article or installation during the course of article manufacture.

The terms "functioning", "function" and "functionality" refer to the utility of the PE. In the case of a camera its "functionality" is its ability to take pictures. In the case of a notebook computer, its "functionality" is based on its ability to receive input signals through the user and perform and output basic tasks such as word processing.

The term "signal" means a multitude of informational packets that can be transferred simultaneously.

In a specific embodiment of the present invention where small dimensions, low power consumption and low fabrication costs are goals, a MEMS fabricated motion sensor (or sensors) packaged into the single modular electronic unit can be incorporated. The motion sensor, fabricated using micro-lithographic techniques, can have several embodiments from a single fabricated component to a plurality of motion sensors to detect all components of motion in the three dimensional planes. The accompanying microprocessor circuitry, in conjunction with the motion sensing system, will output a signal when motion is sensed. Further details in the examples and accompanying figures will illustrate the various methods of measuring motion.

The inventive system includes a motion sensing system based on MEMS fabrication technology and packaged into a single modular electronic component, with an arm/disarm mechanism, a sound system and a power supply.

The arm/disarm mechanism of the inventive system is preferably assigned by a user or article manufacturer at the time of installation. An arm/disarm mechanism illustratively is a three-ring combination lock, a simple keypad, or a password inputted in the case of a PE via the existing input/output mechanism (e.g., keyboard) of the portable electronic. The examples of arm/disarm mechanisms are provided to facilitate the understanding of the invention and should not be interpreted to limit the scope of the invention.

The present invention optionally provides for the manufacturer of an article to integrate the invention therein. An inventive system device can utilize and interact with a portable electronic device power source and sound system. A manufacturer of the PE optionally incorporates the hardware and software implementation for the inventive anti-theft system to interact with a portable electronic microprocessor. In this embodiment, the inventive anti-theft system disables certain preselected functional properties of the PE.

In an alternative embodiment of the invention, a user attaches the encapsulated inventive anti-theft system to an article. The anti-theft system having a devoted power source and sound systems incorporated into the inventive system as a unit.

An inventive system, when in the armed mode (activated by the user/owner of the PE); if motion is sensed or exceeds a predetermined threshold or exceeds a predetermined threshold for a predetermined period of time, the SMU with accompanying circuitry outputs a signal. The signal activates an alarm sound system that is disabled only by the arm/disarm mechanism. It is appreciated that when the article is a PE, the PE manufacturer optionally can disable functional properties of the PE upon reception of said output signal from said SMU. It is also the decision of the PE manufacturer to enable the interaction of the anti-theft device with the PE's existing microprocessor circuitry and input/output systems.

Referring now to the drawings, FIG. 1 shows examples of the coupling of an inventive security single modular unit (SMU), shown generally at 10 into a variety of applications.

An inventive single modular unit 10 is integrated during manufacture or coupled after manufacture into a variety of portable electronics. As shown in FIG. 1, a unit 10 is operative with a portable notebook computer, a video recorder, a personal digital assistant, or digital or analog camera. These portable electronics have internal power systems and integrated circuits that are optionally interfaced with the inventive unit 10 in order to drive the unit 10 and further disable the electronic, respectively. A generic article A as detailed herein typically lacks a viable power source for an inventive unit 10 and as such as inventive unit is powered and operates as a freestanding device coupled to the article A by adhesive or other conventional means.

The inventive unit 10 also is operative in a security perimeter setting. For instance, an inventive unit 10 is attached to an ingress portal P to an area thereby creating a readily transportable and customizable structure security system. Preferably, each of the ingress portals P such as windows and doors defining the area are mounted with an inventive unit 10. Similarly in a field or military setting, an array of inventive units 10 are distributed remote from an area to afford advanced warning of an imminent approach of a human or animal to the area. It is appreciated that the movement required to activate the inventive unit 10 is adjustable through signal processing routines or in the mechanical rigidity of a motion sensing component of the unit 10.

As is indicated and inferred from the illustration, the SMU has small dimensions compared to the PE. Dimensions are typically 5 mm×5 mm×1 mm or smaller. The example of the SMU dimensions is provided to facilitate the understanding of the invention and should not be interpreted to limit the scope of the invention. The size of the present invention enables its integration into an article providing a singular integrated solution for security.

Figure 2:
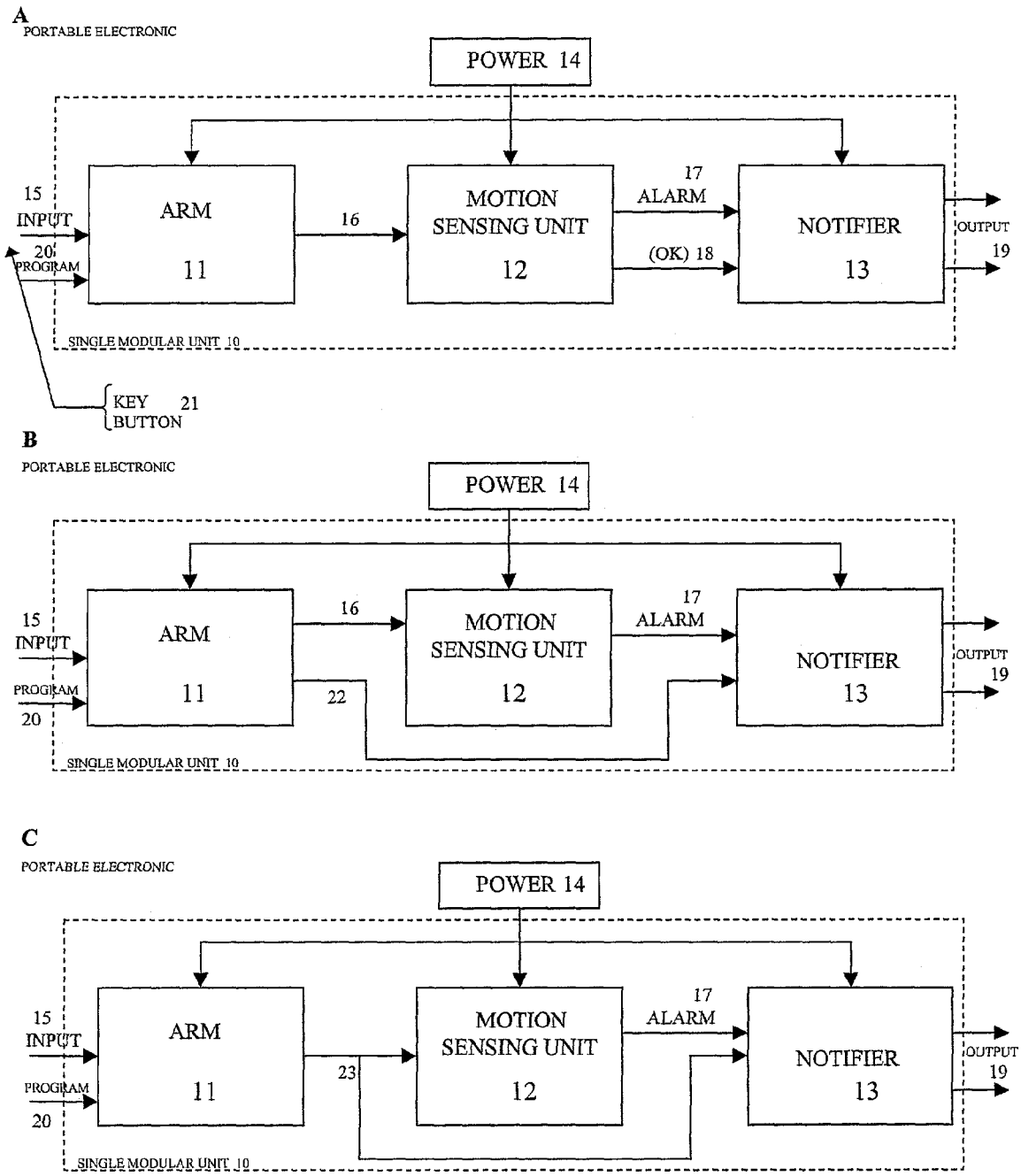
FIG. 2 is a diagram of three embodiments of the invention, encompassed as a single modular component. It shows the connectivity of the major components of the SMU.

FIGS. 2A–C are diagrams of the three main components of the unit 10. These components are: arm/disarm component 11, motion sensing unit 12, and notifier component 13. The notifier component 13 is typically an auditory or visual signal discernable to a user of a unit 10. It is appreciated that a vibratory, or remote broadcast electronic, radio frequency or infrared signal are operative herein to notify a user of the unauthorized movement of an article mounting an inventive unit 10.

The diagrams of FIGS. 2A–C indicate how these components interact, respond to, and output signals where like numerals denote like aspects. It is appreciated that in each of these embodiments all of the components are independently coupled to a power source 14 which is either from a portable electronic power source or from a power source accompanying the unit 10.

In the embodiment shown in FIG. 2A, upon receipt of the input signal 15, the arm/disarm component 11 outputs a signal 16 to the motion sensing unit 12 that in turn outputs an alarm signal 17 to the notifier component 13 which creates a notifier output 19. A program 20 loaded into the unit 10 controls signal processing. A key button 21 is optionally provided as a user interface. Preferably, the motion sensing component 12 outputs an "ok" signal 18 to the notifier component 13.

In the embodiment shown in FIG. 2B, the arm/disarm component 11 outputs two separate signals, a signal 15 to the motion sensing unit 12 and a second signal 22 goes directly to the notifier component 13, providing individual interaction between components 11–12, as well as 11–13.

In the embodiment shown in FIG. 2C, the arm/disarm component 11 outputs a signal 23 to both the motion sensing component 12 and the notifier component 13. The motion sensing component 12 outputs only an alarm signal 17 upon the detection of motion.

Figure 3:
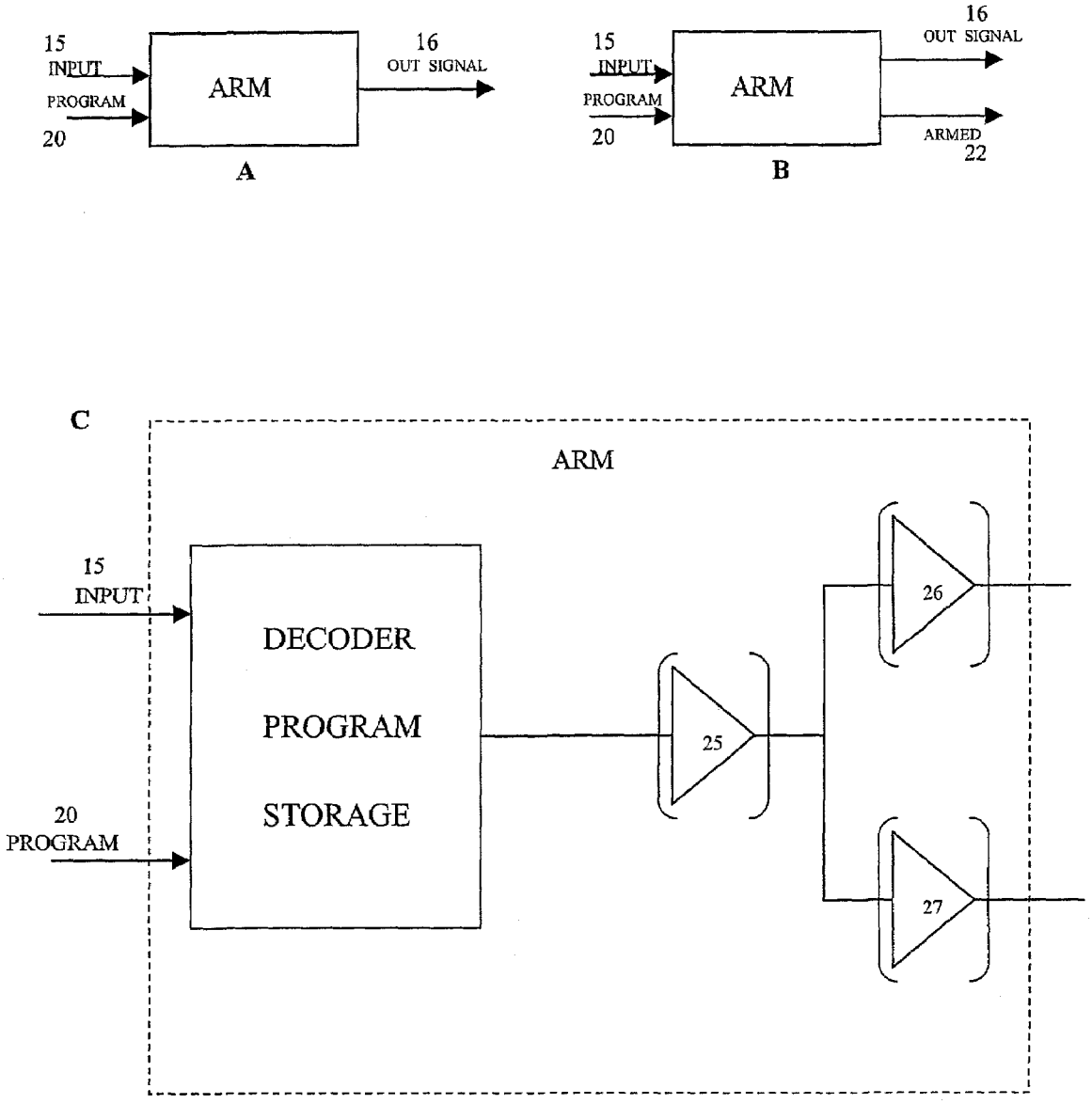
FIG. 3 is a conceptual diagram of stage 1, the arm/disarm component of the SMU.

FIGS. 3A–C are schematic diagrams of the arm/disarm component 11 of the inventive unit 10 where like numerals denote aspects as detailed with respect to the preceding figures. FIGS. 3A and 3B display the conceptual input and output signal 15 of the arm/disarm component 11. FIG. 3C is an expanded view that displays the functional components of the arm/disarm component 11. The arm/disarm component 11 receives two forms of signals from an arm/disarm mechanism. Component 11 receives an "input" signal 15 or a "program" signal 20 arm/disarm mechanisms operative herein illustratively include a three-ring combination lock, a keypad, or a password inputted to a portable electronic via an electronic device existing input/output mechanism (e.g., keyboard). The examples of arm/disarm mechanisms are provided to facilitate the understanding of the invention and should not be interpreted to limit the scope of the invention. The arm/disarm component 11 is capable of performing the functions of "Decoder", "Program" and "Storage". It is appreciated that the arm/disarm component 11 is preferably electronic so as to decrease the dimensions and improve the efficiency of the SMU. The associated circuitry requires an analog to digital converter, and memory. Various designs of circuitry required to perform the specified functions of "decoder", "program" and "store" readily incorporated these functions. Optionally, amplifiers 25, 26 and 27 are utilized on the requisite signals 16 or 22 to be received by components 12 and 13 to achieve the desired response.

Figure 4:
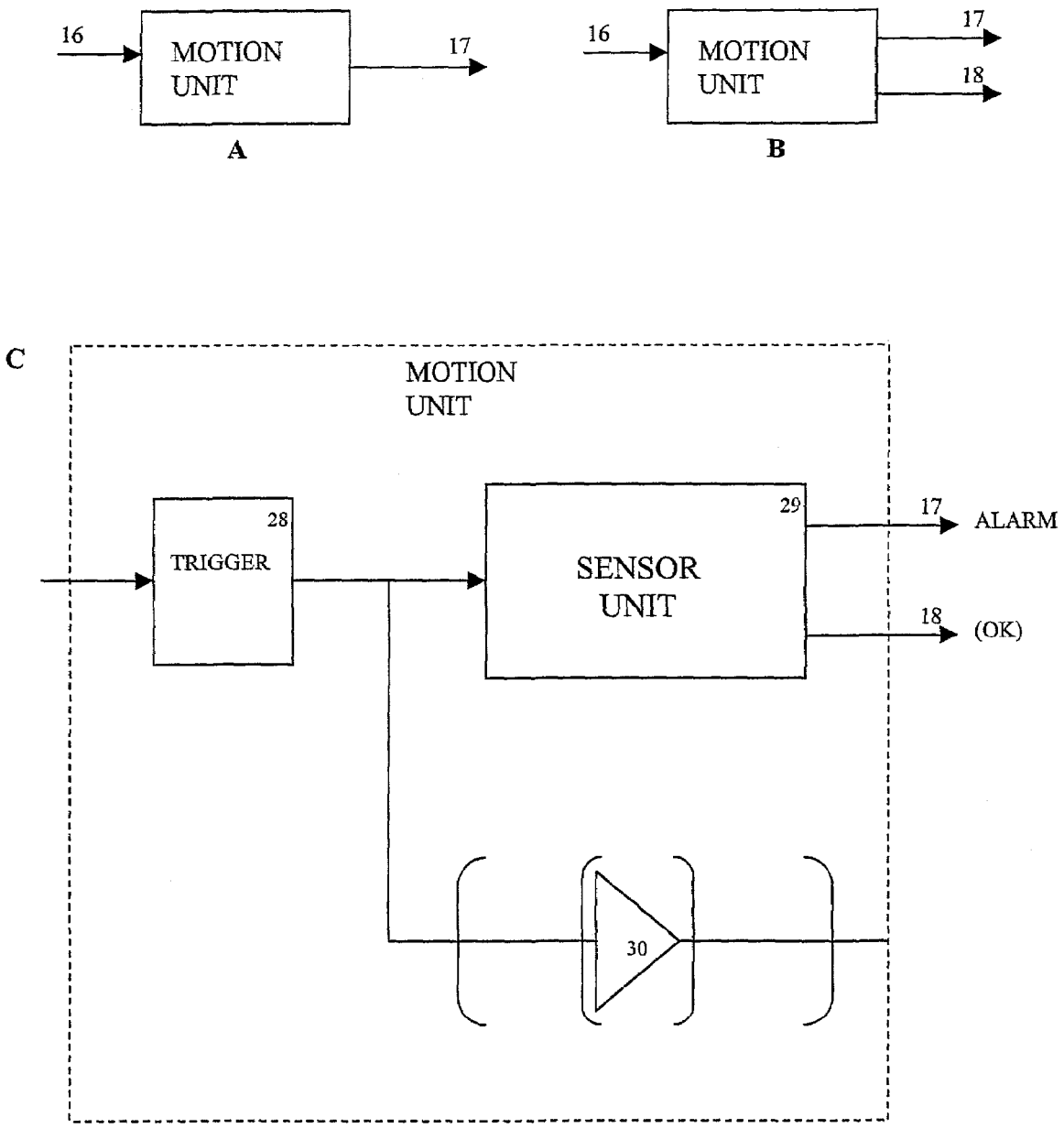
FIG. 4 is a conceptual diagram of stage 2, the sensor component of the SMU.

FIGS. 4A–C are schematic diagrams of the sensor component 12 of the inventive unit 10 where like numerals denote aspects as detailed with respect to the preceding figures. FIGS. 4A and 4B display the input and output signals of the motion sensing unit 12. FIG. 4C displays the functional components of motion sensing unit 12. The output signal 16 from the arm/disarm component 11 is received by a trigger 28 which sends a signal to the sensor unit 29. The sensor unit 29 issues two output signals, an "alarm" signal 17 upon detection of the motion and an optional "ok" signal 18. The output signal from trigger 28 optionally is rerouted and amplified via amplifier 30 to be received by the notifier component 13 of the unit 10. The motion sensing operation is achieved by using a MEMS fabricated motion sensor or sensor packaged into the single modular electronic unit 10. The sensor unit 29, fabricated using micro-lithographic techniques, can have several embodiments from a single fabricated component to a plurality of motion sensors to detect components of the motion in the two or three dimensions. The prototypical sensor unit 29 is a system that detects motion. A MEMS fabricated sensor is preferred due to the consolidation of several advantages such as the ability to sense the motion accurately, minimal power consumption and reduced dimensions. MEMS fabricated motion sensors illustratively include a strain-gauge accelerometer, a capacitive accelerometer, a force-balanced capacitive accelerometer, a piezoelectric accelerometer, a tunneling accelerometer, a latching accelerometer, an accelerometer switch array, a multi-axis accelerometer and a micro-machined gyroscope. A suitable type of motion sensor operative herein is the MEMS accelerometer ADXL 250 (Analog Devices, Norwood, Mass.). Although a MEMS fabricated sensor is preferred in the present invention, it is appreciated that other macroscopically fabricated motion sensors are operative herein, such as mercury switches, piezoresistive switches and any suitable device that detects motion and can be integrated into the unit 10. The accompanying microprocessor circuitry optionally is integrated in the fabrication process of the inventive unit. The accompanying microprocessor circuitry, in conjunction with the sensor unit 29, outputs a signal upon sensing motion, or in various embodiments when the motion exceeds a predetermined threshold, or exceeds a predetermined threshold for a predetermined period of time.

Figure 5:
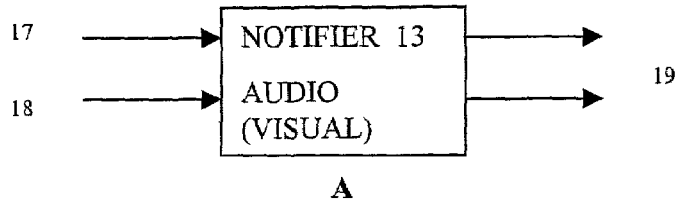
FIG. 5 is conceptual diagram of stage 3, the audio/visual alarm component of the SMU.
Figure 5:
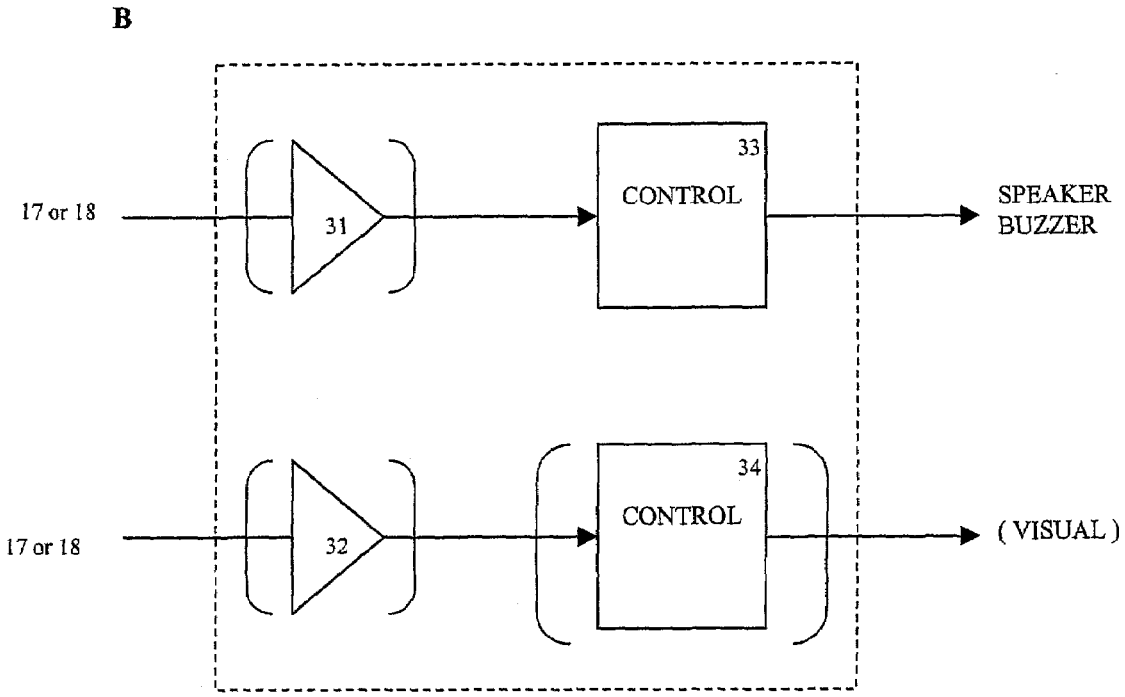

FIGS. 5A–B are schematic conceptual diagrams of the notifier alarm component 13 of the inventive unit 10 where like numerals denote aspects as detailed with respect to the preceding figures. FIG. 5A displays the input and output signal embodiments of notifier audio/visual component 13. FIG. 5B displays the functional components of notifier audio/visual component 13. The input signal 17 or 18 is amplified using amplifiers 31 and 32. The signal 17 or 18 enters the control boxes 33 and 34 from 31 and 32, respectively. In a preferred embodiment of the present invention, the notifier audio/visual component 13 is connected directly to the sound system (not shown) of a portable electronic to produce an audible alarm upon the detection of motion. For a portable electronic or articles lacking a sound system, or for the utility of creating a loud sound using an extremely small device, a buzzer or piezoresistive buzzer is employed. In an alternative embodiment, the notifier 13 provides a visual indication of the "armed" state and/or the detection of motion. The visual display is optionally through a variable light emitting diode (LED) or displayed through the monitor interface of a coupled portable electronic. For example, a portable electronic integrated LED displays a flashing green light when the inventive unit 10 is in the armed state and it turns red upon the inventive unit 10 detection of motion.

FIGS. 6A–B are schematic diagrams for power integration of the inventive unit 10 into, or attached to a portable electronic. In FIG. 6A, the portable electronic and the inventive unit 10 use different individual power sources specifically designated to power each unit. In FIG. 6B, the portable electronic and the unit 10 both use the PE power source. FIGS. 6A and B indicate that the portable electronic and the unit 10 are separate entities which can be powered individually. It is appreciated that the portable electronic and the unit 10 optionally interact as shown by parenthetical arrows. Furthermore, the ability of the unit 10 to interact with the portable electronic enables the unit 10 to determine the functioning of the portable electronic. This provides the option for certain properties of the portable electronic to be disabled upon detection of motion by the unit 10. These functional properties of the portable electronic typically are determined by the manufacturer of the portable electronic and are specific to the nature and functionality of the portable electronic. The distinguishment of the unit 10 and portable electronic highlights the ability of the inventive unit to function even when the portable electronic is turned off. The present invention provides an anti-theft mechanism even when the portable electronic is de-energized.

Figure 7:
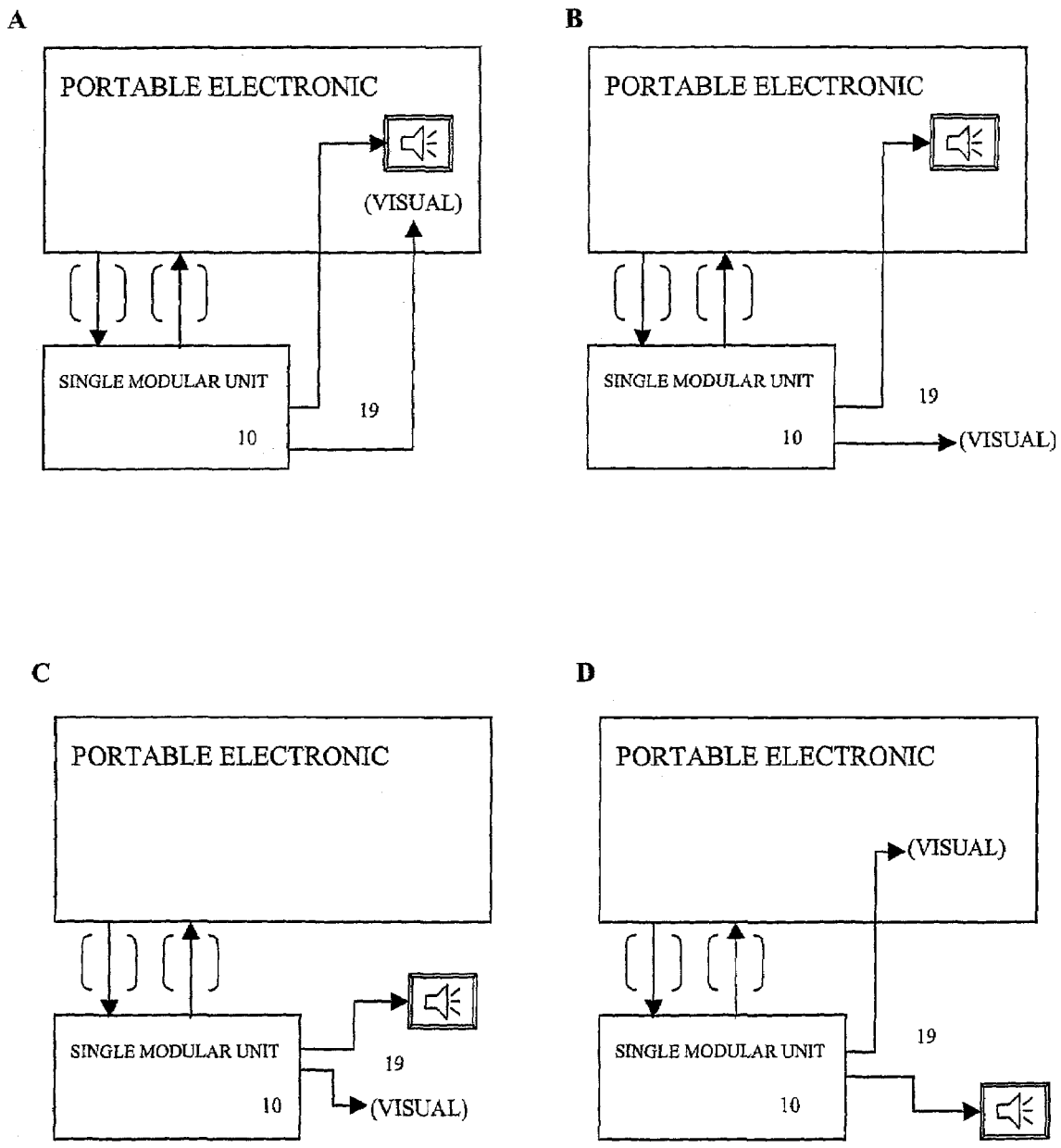
FIG. 7 is a diagram of the embodiments for alarm integration with the SMU and the PE.

FIGS. 7A–D are schematic diagrams of the notifier audio/visual integration with the inventive unit 10 where parenthetical arrows denote optional interactions per FIGS. 6A–B. FIG. 7A shows the unit 10 outputting the auditory and visual signals to the existing, intrinsic sound and visual system of the portable electronic. In this embodiment it is implied that the sound system and visual system are already part of the portable electronic and do not have to be added to provide an anti-theft system. For example, the present invention is integrated into a laptop notebook computer and uses the existing laptop speakers and display interface to achieve its functionality as an anti-theft system.

FIG. 7B has the unit 10 outputting the alarm signal to the existing sound system of the portable electronic. The visual signal is outputted to a visual display system integrated within the unit 10.

FIG. 7C has both the sound system and visual system separate from the existing portable electronic auditory and visual systems. The audio and visual systems in this embodiment are coupled with the unit 10. In a specific embodiment, the audio system is a piezoelectric buzzer and the visual system is a light emitting diode, LED that is coupled with the SMU into the portable electronic. In another embodiment shown in FIG. 7D, the audio system is coupled with the unit 10 and the unit 10 outputs the visual signal to the existing visual system of the portable electronic. This embodiment is particularly well suited for a camera that might have an existing visual display system, but no requisite audio system.

Figure 8:
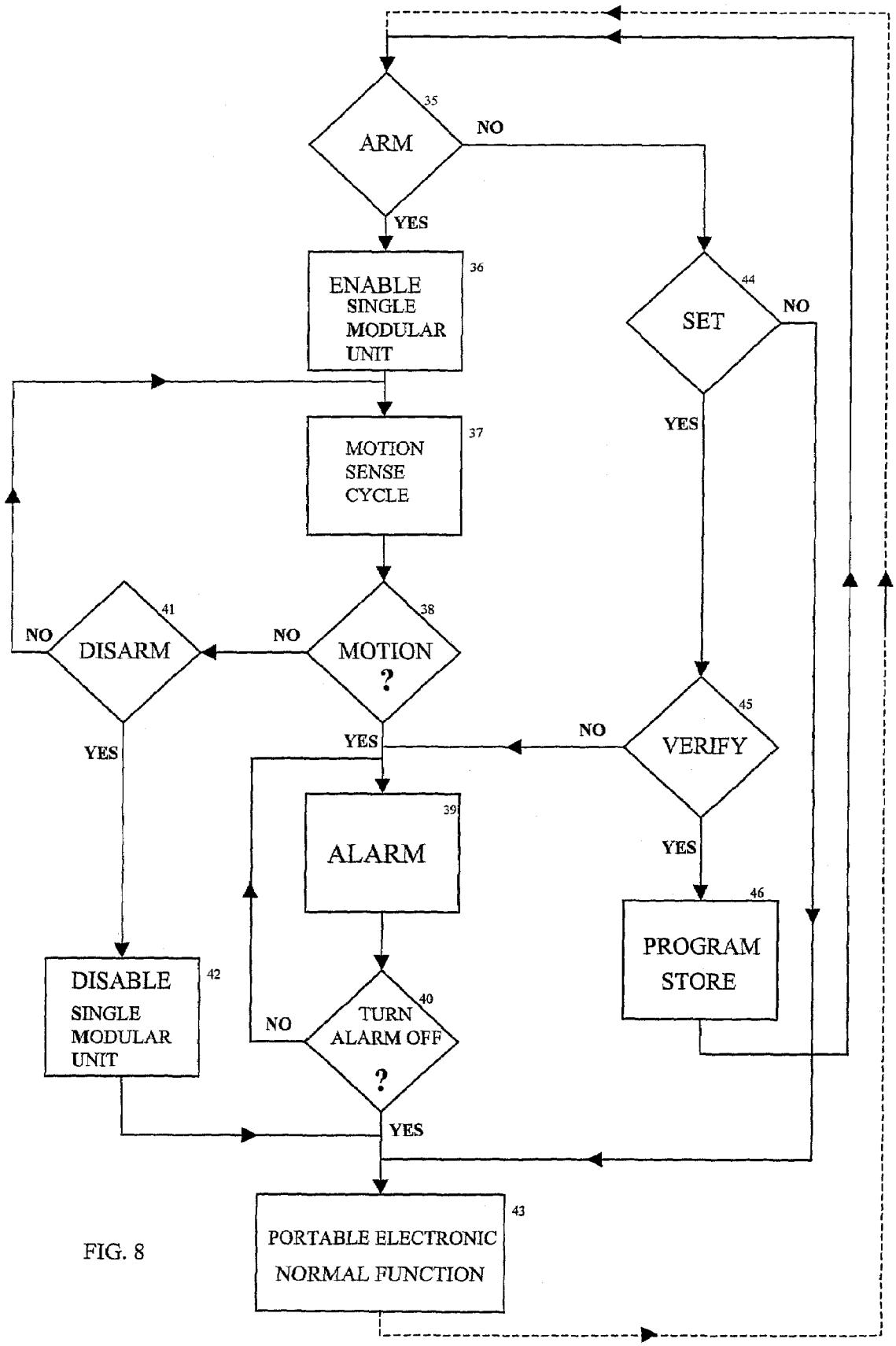
FIG. 8 is a simplified flow chart illustrating the general functioning of the present invention.

FIG. 8 is a functional flow chart of the present invention and illustrates how an inventive unit processes information and interacts with other external components such as the sound system and the arm/disarm mechanism. When the system is at the Arm stage 35, if the inventive unit has not been armed, it goes to Set mode 44. If the unit has not been set, the PE can perform its normal functions 43 and operate normally.

If the user elects to set the code for the unit, the unit receives the code from the arm/disarm mechanism and Verifies 45 the code. As an anti-tamper mechanism to prevent the thief or other users to change, alter, hack, or pick the code, if the code is not Verified 45, the Alarm 39 system is signaled and the inventive unit outputs a signal to the sound system. If the code is Verified 45, the code is Stored 46 and returns the unit to the Arm 35 decision state.

If the unit receives the correct arm code from the arm/disarm mechanism, it moves from the Arm 35 decision state and goes to the enabling Single Modular Unit state 36. This commences the Motion Sense Cycle 37 loop. At the motion decision state 18 if no motion is detected and the Disarm decision state 41 does not receive a disarm code from the arm/disarm mechanism, the unit loops back to the Motion Sense Cycle 37 stage. It is anticipated that this loop can occur several times a second to ensure efficient detection of motion although it is appreciated modifications can exist depending on the desired anti-theft efficiency and power consumption rate. If the unit is Armed 35 and is looping through the motion sense cycle 37, 38, 41, 37, and the user wishes to disarm the mechanism, the Disarm 41 decision state receives the correct code from the arm/disarm mechanism and goes to the Disable SMU 42 state. The Disable SMU 42 state disables the motion sensing component of the unit and further allows the normal functioning 43 of an attached portable electronic.

If the inventive unit is in the motion sensing cycle 37 loop indicating that it has been Armed 35 and the motion is detected 38, the unit outputs an Alarm 39 signal which turns on the sound system. If at the Turn Alarm Off 40 decision state, no requisite code is received, the Alarm 39 signal is maintained. Furthermore, in a specific embodiment, the portable electronic is prevented from performing normal functions 43. If the requisite code, which was set from before through the Set mode 44 is received, the Alarm signal is turned off and the inventive unit goes to the portable electronic normal function 43 state.

Variations and equivalents will be apparent by one of ordinary skill in the art upon reading of the specification. For example, the inventive unit optionally is activated if it detects a period of portable electronic inactivity providing a passive automatic form of anti-theft. Furthermore, the inventive unit is readily connected to a GPS system and/or a wireless networking system (e.g. a cellular network or wireless LAN (IEEE 802.11.b or others)) that indicates the status and location of the portable electronic and alerts the appropriate authorities. The inventive unit readily is integrated into a PCMIA or PC card form for insertion into an available card slot.

Those patents and publications cited herein are indicative of the level of skill in the art to which the invention pertains. These patents and publications are herein incorporated by reference to the same extent as if each was specifically and individually incorporated by reference.

Those skilled in the art will be able to ascertain using no more than routine experimentation, many equivalents to the embodiments and practices described above. It will be understood that the invention is not to be limited to the embodiments disclosed herein, but is to be understood from the following claims, which are to be interpreted as broadly as allowed under the law.

What is claimed is:

1. A security system comprising in combination within a single module:

an arming component creating an output signal;

a motion sensing component activated by the output signal and generating an alarm signal upon the system being moved; and a notifier component activated by receipt of said alarm signal.

2. The security system of claim 1 wherein said arming component generates a second signal communicated directly to said notifier component.

3. The security system of claim 1 wherein said motion sensing component generates an "ok" signal for receipt by said notifier component absent the system being moved.

4. The system of claim 1 further comprising an amplifier for modifying at least one signal selected from the group consisting of said output signal, an arming component armed signal, said alarm signal, and a motion sensing component "ok" signal.

5. The system of claim 1 wherein said motion sensing component comprises a trigger and a sensor unit.

6. The security system of claim 5 wherein said sensor unit is a MEMS motion sensor.

7. The security system of claim 6 wherein said MEMS motion sensor is selected from a group consisting of: strain-gauge accelerometer, a capacitive accelerometer, a force-balanced capacitive accelerometer, a piezoelectric accelerometer, a tunneling accelerometer, a latching accelerometer, an accelerometer switch array, a multi-axis accelerometer and a micro-machined gyroscope.

8. The security system of claim 5 wherein the sensor unit comprises a motion sensitive switch selected from the group consisting of: mercury switch and piezoresistive switch.

9. The security system of claim 1 further comprising a single modular unit power source.

10. The security system of claim 1 further comprising an encapsulant around the single module.

11. A process for indicating unauthorized movement of a portable electronic comprising the steps of:

coupling a security system according to claim 1 into the portable electronic; and energizing the security system.

12. The process of claim 11 wherein said security system is energized by a power source intrinsic to the portable electronic.

13. The process of claim 11 wherein said security system is internal to the portable electronic.

14. The process of claim 11 wherein said security system is energized by a security system devoted power source.

15. A security system of comprising in combination within a single module:

an arming component creating an output signal;

a motion sensing component activated by the output signal and generating an alarm signal upon the system being moved; and a notifier component activated by receipt of said alarm signal, said output signal being simultaneously provided to said motion sensing component and said notifier component.

16. A security system comprising in combination within a single module:

an arming component creating an output signal;

a motion sensing component comprising:

a MEMS motion sensor, and a trigger, activated by the output signal reaching said trigger and generating an alarm signal upon said MEMS motion sensor being moved; and an audio or visual notifier component activated by receipt of said alarm signal.

17. The security system of claim 16 wherein said arming component generates a second signal communicated directly to said notifier component.

18. The security system of claim 16 wherein said trigger generates an "ok" signal for receipt by said notifier component absent said MEMS motion sensor being activated.

19. The system of claim 16 further comprising an amplifier for modifying at least one signal selected from the group consisting of said output signal, an arming component armed signal, said alarm signal, and a motion sensing component "ok" signal.

20. The security system of claim 16 wherein said MEMS motion sensor is selected from a group consisting of: strain-gauge accelerometer, a capacitive accelerometer, a force-balanced capacitive accelerometer, a piezoelectric accelerometer, a tunneling accelerometer, a latching accelerometer, an accelerometer switch array, a multi-axis accelerometer and a micro-machined gyroscope.

21. The security system of claim 16 wherein said MEMS motion sensor comprises a motion sensitive switch selected from the group consisting of: mercury switch and piezoresistive switch.

22. The security system of claim 21 further comprising a single modular unit power source.

23. The security system of claim 16 further comprising an encapsulant around the single module.

24. A security system comprising in combination within a single module:

an arming component creating an output signal;

a motion sensing component comprising:

a MEMS motion sensor, and a trigger, activated by the output signal reaching said trigger and generating an alarm signal upon said MEMS motion sensor being moved; and an audio or visual notifier component activated by receipt of said alarm signal, said output signal is provided simultaneously to said trigger and said notifier component.

* * * * *